United States Patent [19]

Wilson

[11] 4,316,756

[45] Feb. 23, 1982

[54] METHOD FOR BONDING A POCKET BLANK TO A GARMENT PORTION

[75] Inventor: Robert J. Wilson, Norcross, Ga.

[73] Assignee: GFF, Inc., Cincinnati, Ohio

[21] Appl. No.: 178,469

[22] Filed: Aug. 15, 1980

[51] Int. Cl.[3] ..... A41D 27/20

[52] U.S. Cl. ..... 156/227; 2/243 B; 2/247; 156/251; 156/265; 156/292; 156/299; 156/308.4; 156/444; 156/511; 156/521

[58] Field of Search ..... 156/216, 227, 251, 263, 156/264, 265, 292, 299, 308.4, 234, 362, 443, 444, 475, 511, 517, 521, 552, 556, 566; 2/243 B, 247; 112/121.12, 121.15

[56] References Cited

U.S. PATENT DOCUMENTS

| | | | |
|---|---|---|---|
| 1,955,637 | 4/1934 | Klau | 112/121.15 |
| 2,685,550 | 8/1954 | Corey | 2/247 |
| 2,922,167 | 1/1960 | Berlin | 2/243 |
| 3,137,865 | 6/1964 | Evans et al. | 2/247 |
| 3,284,808 | 11/1966 | Evans et al. | 2/247 |
| 3,335,682 | 8/1967 | Tucci | 2/247 |
| 3,338,773 | 8/1967 | Schneider | 156/444 |
| 3,670,675 | 6/1972 | Rovin et al. | 112/121.12 |
| 3,699,591 | 10/1972 | Breitkopf | 2/243 R |
| 3,840,901 | 10/1974 | Eyster | 2/247 |
| 3,881,041 | 4/1975 | Glienke | 156/234 |
| 3,895,590 | 7/1975 | Perlino | 112/121.12 |
| 4,003,775 | 1/1977 | Batt et al. | 156/227 |
| 4,034,858 | 8/1977 | Dantowitz | 156/251 |
| 4,124,424 | 11/1978 | Preston | 156/204 |
| 4,156,293 | 5/1979 | Off | 2/247 |

*Primary Examiner*—Jerome W. Massie
*Attorney, Agent, or Firm*—Robert M. Ward

[57] ABSTRACT

The method of bonding a pocket blank to a garment portion of the present invention comprises the steps of providing a pocket blank at a first station. The pocket blank is conveyed to a second station. The bottom and side margin tabs of the pocket blank are folded over the pocket body. Heat and pressure are utilized to apply a strip of heat fusing adhesive to a top margin tab of the pocket blank. Heat and pressure are also applied to the folded over side and bottom margin tabs to crease the same. Next, the top margin tab bearing the adhesive is folded over and heat and pressure are applied to bond the same to the pocket body. Heat and pressure are applied to fuse strips of the heat fusing adhesive to the side and bottom margin tabs of the pocket blank. The prepared pocket blank is then conveyed along the path of travel to a third station where an overlaid garment portion is heat and pressure bonded to the prepared pocket blank.

A preferred apparatus for carrying out the method of bonding a pocket blank to a garment portion of the present invention is also set forth.

14 Claims, 16 Drawing Figures

METHOD FOR BONDING A POCKET BLANK TO A GARMENT PORTION

BACKGROUND OF THE INVENTION

The present invention relates generally to fixing pockets on garments and more particularly to a method and apparatus of providing a pocket blank and bonding the pocket blank to a provided garment portion.

In the prior art, various techniques have been utilized for affixing a pocket to a portion of a garment. One example of such an application is the sewing of a pocket blank to a front panel of a shirt. This method, of course, necessitates considerable hand labor, which is at increased expense to the producer and to the consumer.

Hot melt film adhesives have been proposed to the garment industry to serve as a substitute for the sewing process. Due to the inability of prior art heat sealing adhesives to withstand both industrial and commercial laundering, as well as professional dry cleaning, the application of such films for adhesives to the garment industry has been of limited utility.

Also, hand labor has been necessitated in the use of such available hot melt strip adhesives, which has not optimally reduced the cost of affixing the pocket.

Based upon these deficiencies and shortcomings of the prior art there has been a considerable need for an automated method and apparatus for bonding a pocket blank to a garment portion. Accordingly, it is an object of the method of bonding a pocket blank to a garment portion of the present invention to overcome these disadvantages and deficiencies.

SUMMARY OF THE INVENTION

The method of bonding a pocket blank to a garment portion of the present invention comprises the steps of providing a pocket blank having front and rear surfaces and comprising a pocket body and laterally extending top, bottom and side margin tabs. Each such pocket blank is preferably cut at a first station.

The pocket blank is conveyed from the first station along a path of travel having a longitudinal dimension to a second station. The bottom and side margin tabs of the pocket blank are folded over into general proximity with the rear surface of the pocket body. Heat and pressure are utilized to apply a strip of heat fusing adhesive to fuse the same to the rear surface of the top margin tab of the pocket blank. Preferably simultaneously therewith, heat and pressure are applied to the folded over side and bottom margin tabs of the pocket blank to crease the rear surface thereof into intimate contact with the adjacent portion of the surface of the pocket body.

Next, the top margin tab bearing the adhesive thereon is folded over and heat and pressure are applied to bond the rear surface thereof to the rear surface of the adjacent portion of the rear surface of the pocket body. Preferably simultaneously therewith, heat and pressure are applied to fuse strips of the heat fusing adhesive to respective front surface of the side and bottom margin tabs of the pocket blank.

The prepared pocket blank is then conveyed along the path of travel to a third station where a piece of garment cloth larger in size than that selected for the garment portion is provided, preferably from a continuous supply. The garment cloth is overlaid atop the prepared pocket blank to position the prepared pocket blank in the selected position thereon. The garment cloth is then cut to the shape selected for the garment portion.

Thereafter, heat and pressure are applied to the garment portion opposite the downwardly disposed adhesive strip on the front surface of the creased side and bottom pocket margin tabs to fuse the prepared pocket blank to the garment portion at the side and bottom portion thereof to form a pocket thereon. The garment portion with pocket fused thereon is then conveyed away for assembly into a garment.

The apparatus of the present invention for carrying out the method of bonding a pocket blank to a garment portion includes a conveyor having means for intermittent controlled movement along the longitudinal dimension in a defined path of travel. A continuous supply of pocket blank cloth is disposed transversely across one end of the conveyor at a first station. A pocket blank cutting die assembly is disposed at the first station and supported above the plane of the conveyor for intermittent downward motion at controlled intervals to cut a series of pocket blanks. Each pocket blank has front and rear surfaces and each has a pocket body with connected laterally extending top, side and bottom member tabs.

Means for detecting a pocket blank on the conveyor and for stopping the conveyor travel to dispose the pocket blank at a second station are operatively connected to the conveyor. A heated platen is disposed at the second station above the plane of the conveyor for downward motion to engage the conveyed, detected and stationarily disposed pocket blank. Pocket body restraining means, preferably in the form of a wire frame, are disposed above the plane of the conveyor for lowering and engagement on the pocket blank at the connections between the pocket body and the top, side and bottom member tabs thereof to leave the top, side and bottom member tabs unrestrained against upward motion. Air blast nozzles are disposed beneath the plane of the conveyor to direct blasts of air upwardly and against the respective member tabs to dispose the same in general proximity to the pocket body adjoining surfaces.

A plurality of adhesive supply spools, each bearing a roll of heat fusing adhesive, and each having a paired release backing take-up spool are disposed for positioning a strip of adhesive above the respective member tabs of the pocket blank to be pressed downwardly for engagement with and fusing to the respective member tabs. A heated platen is disposed above the plane of the conveyor for downward motion to crease the respective member tabs and to apply a strip of adhesive to the pocket blank cloth, the platen being of such a temperature as to soften the adhesive sufficiently so as to cause application of the adhesive to the cloth limited to areas of contact with the platen, and to cause breakage of the supplied adhesive strip in unheated areas after the adhesive strip has been pressed downwardly by the heated platen and in returning to its disposition above the plane of the conveyor.

A third station is provided in preferred embodiments and includes a similarly disposed heated platen for bonding a prepared pocket blank to a garment portion. The garment portion in preferred embodiments is cut by a die disposed at the third station from a continuous supply of garment cloth, and preferably simultaneously with such bonding.

The method and apparatus for bonding a pocket blank to a garment portion of the present invention may be better understood with respect to the accompanying drawing, the following brief description of the drawing, the detailed description of preferred embodiments and the appended claims.

BRIEF DESCRIPTION OF THE DRAWING

The drawing appended to the present application is illustrative of exemplary embodiments of the method and apparatus for bonding a pocket blank to a garment portion of the present invention, and in which.

DETAILED DESCRIPTION OF PREFERRED EMBODIMENTS

Figure 1:
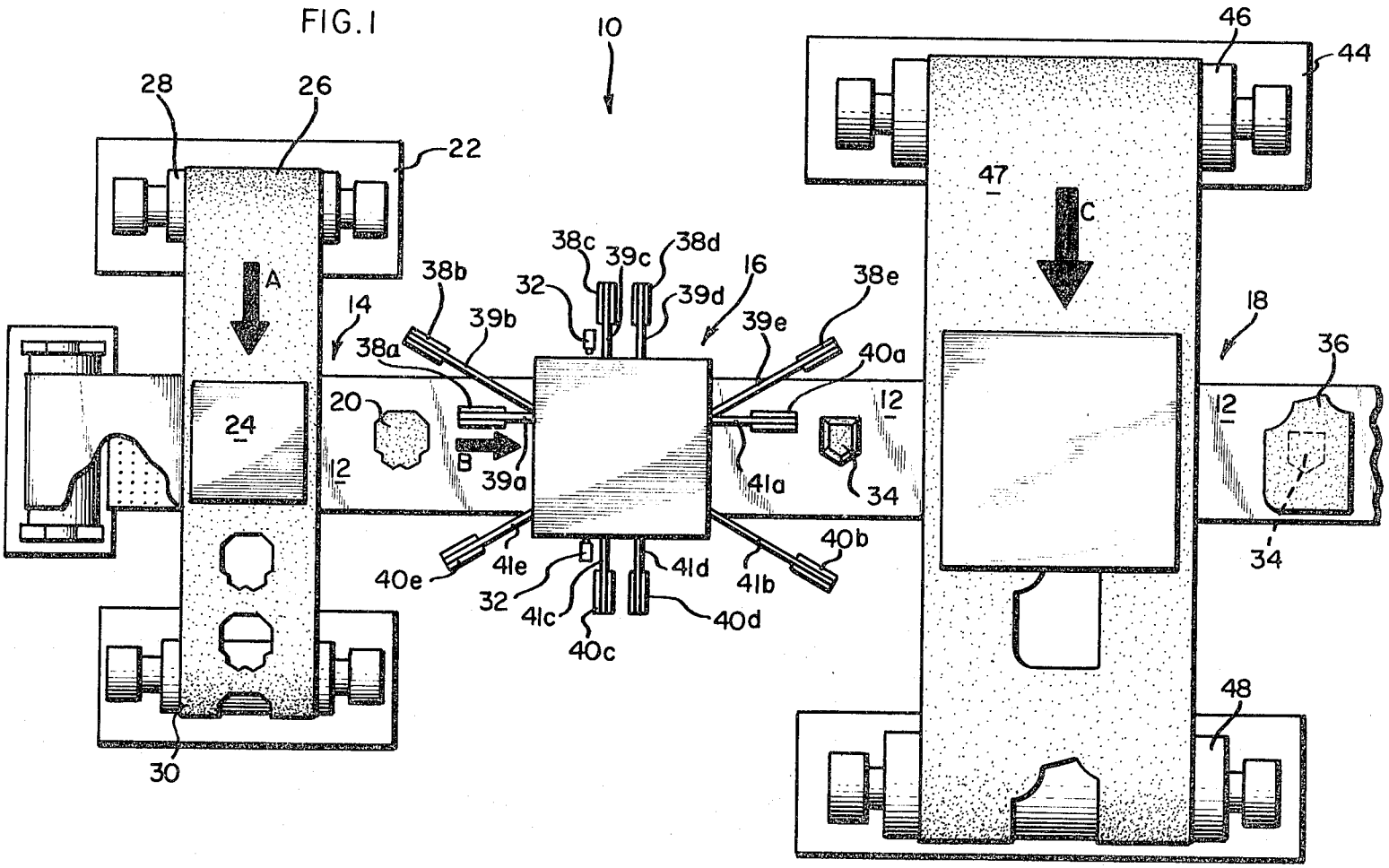
FIG. 1 is a plan view of an apparatus suitable for performing the method of bonding a pocket blank to a garment portion of the present invention showing three stations, wherein the first station includes a pocket blank supply means (see Arrow A) for continuously supplying pocket blank material to a pocket blank cutting die to form pocket blanks for transportation along a conveyor (see Arrow B) to the second station, which includes member tab folding means, adhesive supply means, and heat and pressure means for forming a prepared pocket blank to be transmitted along the conveyor to a third station, which includes means for continuously supplying garment portions (see Arrow C) for application of the prepared pocket blank thereto by means of heat and pressure.

The method of bonding a pocket blank to a garment portion of the present invention comprises the steps of providing a pocket blank having front and rear surfaces and comprising a pocket body and laterally extending top, bottom and side margin tabs. The pocket blank is conveyed along a path of travel having a longitudinal dimension.

The bottom and side margin tabs are folded over into general proximity with the rear surface of the pocket body. Heat and pressure are applied to a strip of heat fusing adhesive to fuse the same to the rear surface of the top margin tab of the pocket blank. Preferably simultaneously therewith, heat and pressure are applied to the folded over side and bottom margin tabs of the pocket blank to crease the rear surface thereof into intimate contact with the adjacent portion of the rear surface of the pocket body and to display the front surface thereof for application of respective strips of adhesive thereto.

The top margin tab bearing adhesive thereon is folded over, and heat and pressure are applied thereto to bond the rear surface thereof to the rear surface of the adjacent portion of the pocket body. Preferably simultaneously therewith, heat and pressure are applied to fuse strips of heat fusing adhesive to the respective and displayed front surfaces of the side and bottom margin tabs of the pocket blank to form a prepared pocket blank for bonding to a garment portion.

A piece of garment cloth larger in size than that selected for the garment portion is provided and overlaid atop the prepared pocket blank to position the prepared pocket blank in selected disposition thereon. The garment cloth is preferably then cut to the shape selected for the garment portion. Preferably simultaneously therewith, heat and pressure are applied to the garment portion opposite the upwardly disposed adhesive strips on the respective front surfaces of the creased side and bottom pocket margin tabs to fuse the prepared pocket blank to the garment portion at the sides and at the bottom portions thereof to form a pocket thereon. Finally, the garment portion with pocket fused thereon is conveyed away for assembly of the garment.

In preferred embodiments, the pocket blank is provided with two bottom margin tabs in V-shaped disposition for forming a pocket with a V-shaped bottom. Of course, other final pocket styles having other margin tab arrangements are considered to be included within the scope of the present invention.

A preferred method of folding the top, bottom and side margin tabs of the preferred pocket blank is by blasting compressed air under and lateral of the respective margin tabs. During this air blasting, the pocket body is bordered in preferred embodiments adjacent the side and bottom margin tabs to demarcate the pocket body, whereby the side and bottom margin tabs may be thereafter accurately creased.

In preferred embodiments, the strip of adhesive is fused to the top margin tab simultaneously with the creasing of the folded over side and bottom margin tabs. Also in preferred embodiments, heat and pressure are applied to bond the top margin tab to the pocket body at the same time strips of adhesive are applied to the side and bottom margin tabs.

The pocket blank is preferably restrained downwardly immediately after application of the respective adhesive strips to the top margin tab, and immediately after such application to the side and bottom margin tabs, to prevent the pocket blank from being carried upwardly. Also, the garment portion is preferably cut from the garment cloth simultaneously with the fusing of the prepared pocket blank to the garment portion.

In preferred embodiments, the additional steps of providing a continuous roll of pocket blank material disposed transversely to the lateral dimension of the path of travel of the pocket blank, and the cutting of the pocket blank from the continuous supply, are also included. In preferred embodiments, the cutting of the pocket blank is preferably accomplished with its side margin tabs disposed substantially parallel to the longitudinal dimension of the path of travel, and such side margin tabs are preferably disposed transversely to the longitudinal dimension of travel during conveyance thereof. The garment blank is preferably cut from a continuous supply of garment cloth which is also disposed transverse to the longitudinal dimension of path of travel.

In such preferred embodiments, the same source of heat and pressure at station two is utilized for the margin tab creasing, adhesive fusing and bonding steps, in the formation of the prepared pocket blank.

The apparatus of preferred embodiments of the present invention for bonding a pocket blank to a garment portion has a conveyor, which includes means for the intermittent controlled movement of the same, with the conveyor having a longitudinal dimension along a defined path of travel. Pocket blank supply means are provided for supplying to the conveyor at a first station a plurality of pocket blanks, each pocket blank having a front and rear surface, and each pocket blank having a pocket body with connected laterally extending top, side and bottom member tabs, with each tab having a leading edge and a trailing edge to define respective tab lengths.

Means are included for detecting a pocket blank on the conveyor and for stopping the conveyor travel to dispose the pocket blank in proper position at a second station for application of adhesive, and subsequently to dispose the pocket blank at a third station for fusing thereof to a garment portion.

Pocket body demarcation means are disposed above the plane of the conveyor for lowering and engagement on the pocket blank at the connections between the pocket body and the top, side and bottom member tabs thereof, leaving thereby the top, side and bottom member tabs unrestrained against upward movement. Member tab folding means are provided to fold reflexively at a fold line the respective member tabs into general proximity with the adjacent areas of the pocket body rear surface to display the front side of the tabs upwardly for application of respective adhesive strips thereto. Adhesive supply means are disposed above the conveyor for supplying strips of adhesive of a length corresponding to the length of the respective tabs for fusing to the respective tabs.

First heat and pressure means are provided for fusing the adhesive strips to the respective tabs, and for separately creasing the same along the respective fold lines into intimate proximity with the rear surface of the pocket body for forming a prepared pocket blank for fusing to a garment portion. Means disposed at the third station are provided for supplying a garment portion to overlay each prepared pocket blank and for fusing thereto.

A second heat and pressure means for application to the garment portion is disposed at the third station and atop the prepared pocket blank for fusing the same together. Control means for sequencing the operation of the various elements including the pocket blank supply means, the conveyor, the member tab folding means, the adhesive supply means, the first heat and pressure means, the garment portion supply means and the second heat and pressure supply means, is provided.

In the apparatus for bonding a pocket blank to a garment portion of the present invention, the pocket blank supply means in preferred embodiments includes a continuous supply of pocket blank cloth disposed transversely across one end of the conveyor at the first station. In such preferred embodiments, the pocket blank supply means further includes a pocket blank cutting die assembly having dimensions selected to cut the particular pocket blank to the shape and size desired. The die is disposed at the first station and supported above the plane of the conveyor for intermittent downward motion at controlled intervals to cut a plurality of pocket blanks. In these preferred embodiments, the pocket blank cutting die assembly is preferably disposed with respect to the continuous supply of pocket blank cloth to cut the pocket blank with its side member tabs parallel to the longitudinal dimension of the conveyor path of travel. Also in these preferred embodiments, means are preferably further included for rotating the pocket blank to dispose the side member tabs thereof transversely to the longitudinal dimension of the conveyor path of travel.

The pocket body demarcation means preferably comprise a folding wire frame, the wires of which are disposed in operative engagement with the pocket blank between the pocket body thereof and the respective member tabs thereof to restrain the pocket body downwardly. This functioning permits the respective member tabs to remain unrestrained against being folded upwardly and over the folding wire frame.

In preferred embodiments of the apparatus for bonding a pocket blank to a garment portion of the present invention, the member tab folding means preferably comprises air blast nozzles which are disposed beneath the plane of the conveyor to direct blasts of air upwardly against the front surface of the member tabs to raise the same upwardly. Also included are air blast nozzles disposed above the plane of the conveyor for directing blasts of air laterally and against the front surface of the upwardly raised member tabs to fold reflexively the same over the pocket body demarcation means and into general proximity with adjacent areas of the pocket body rear surface to display the front side of the member tabs upwardly for application of adhesive thereto.

The adhesive supply means in preferred embodiments preferably comprises a plurality of adhesive supply spools each bearing a roll of heat fusing adhesive in strip form disposed upon a release backing, and further comprises a plurality of corresponding, paired release backing take-up spools, each such paired supply and take-up spool for disposing a strip of adhesive above each of the member tabs of the pocket blank, whereby a strip of adhesive may be pressed downwardly for engagement with and for fusing to the respective member tabs.

The first heat and pressure means in preferred embodiments comprises a first heated platen. Such heated platen preferably includes an independent downwardly disposable central portion for holding down the pocket body during the upward return motion of the platen after application of the respective adhesive strips, whereby freedom from sticking of the adhesive bearing member tabs to the platen is enhanced. Such first heat and pressure means is adapted in preferred embodiments to apply the adhesive strips to substantially the entirety of the length of the member tabs from the leading edge thereof to the trailing means thereof.

Such preferred first heated platen is maintained at such a temperature as to soften the adhesive sufficiently so as to cause application of the adhesive to the pocket blank cloth confined to areas of contact with the heated platen, and to cause terminal breakage of the supplied adhesive strip outside the trailing edge of the respective member tabs. Each such preferred adhesive supply means may preferably include control means for unrolling each respective heat fusing adhesive strip for disposition of the point of terminal breakage of the adhesive strip substantially directly above the leading edge of each respective member tab.

The preferred means for supplying the garment portion includes a continuous garment cloth supply means disposed to supply such garment cloth in a path of travel transverse to that of the longitudinal dimension of the conveyor path of travel. In such embodiments, a garment cloth cutting die is provided for cutting individual garment portions. In such preferred embodiments, the garment cloth cutting die is disposed for simultaneous operation with the second heat and pressure means. These preferred second heat and pressure means comprise a second heated platen disposed above the plane of the conveyor for intermittent downward motion corresponding to the presence of a prepared pocket blank therebeneath for fusing.

Figure 2:
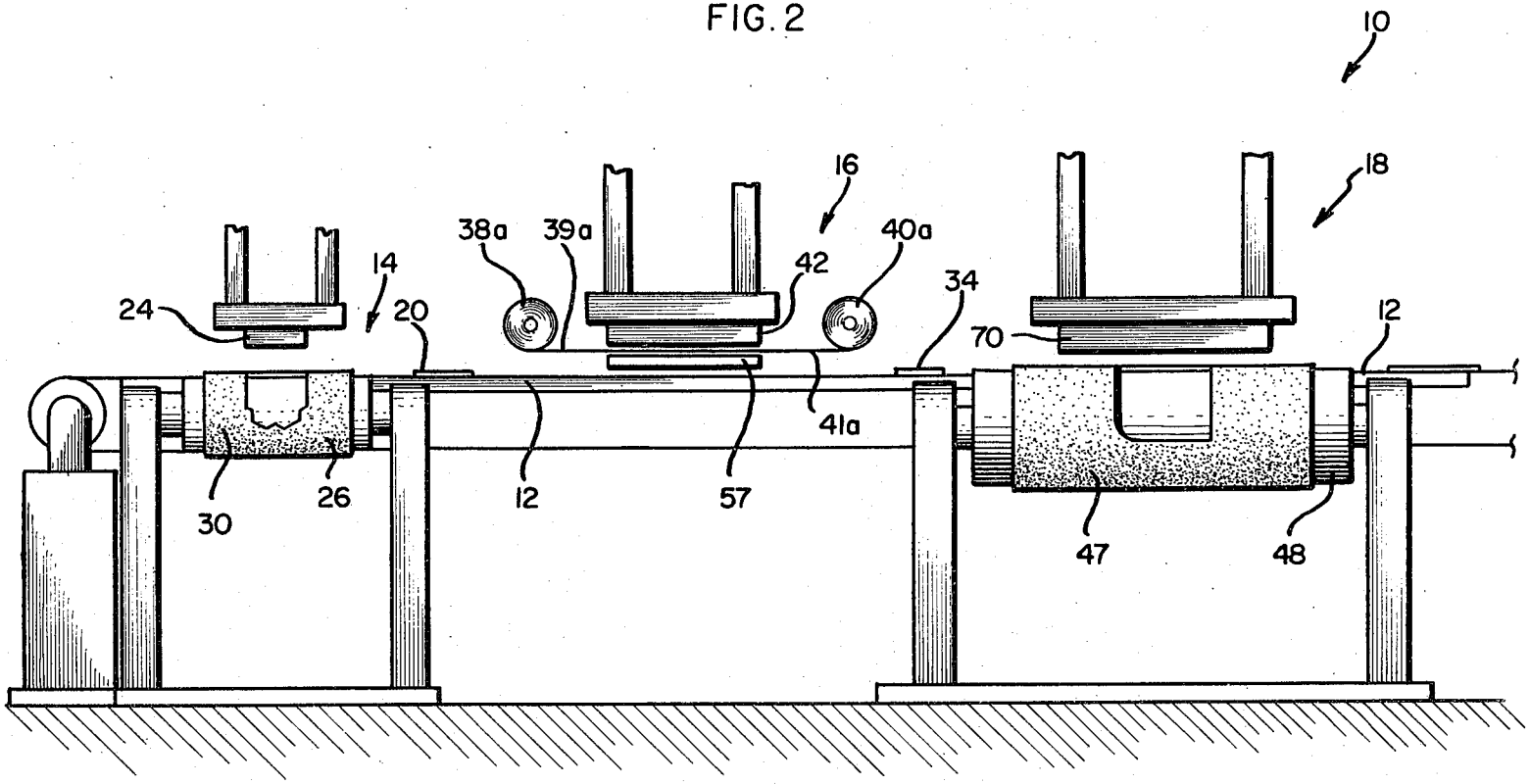
FIG. 2 is a longitudinal side view of the embodiment of the apparatus for bonding a pocket blank to a garment portion as shown in FIG. 1.

Referring now to the drawing and to FIGS. 1 and 2 in particular, a preferred embodiment of the apparatus for bonding a pocket blank to a garment portion of the present invention generally designated as 10 is depicted. A conveyor 12 is provided which extends across three stations respectively generally 14, 16, 18 and defines a longitudinal dimension to provide a direction of travel for a pocket blank 20 as shown at Arrow B. First station 14 includes a pocket supply means 22 for supplying to conveyor 12 a plurality of pocket blanks 20. Pocket blanks 20 are preferably cut by means of a cutting die 24 from a roll 26 of continuously fed pocket blank material as shown at Arrow A, and extending between a feed roller 28 and a pocket blank take-up roller 30. Pocket blanks 20 may be cut longitudinally as shown in FIGS. 1 and 2, or in alternative embodiments, may be cut transversely from the roll of continuously supplied pocket material, and then rotated 90° for further processing.

Figure 9:
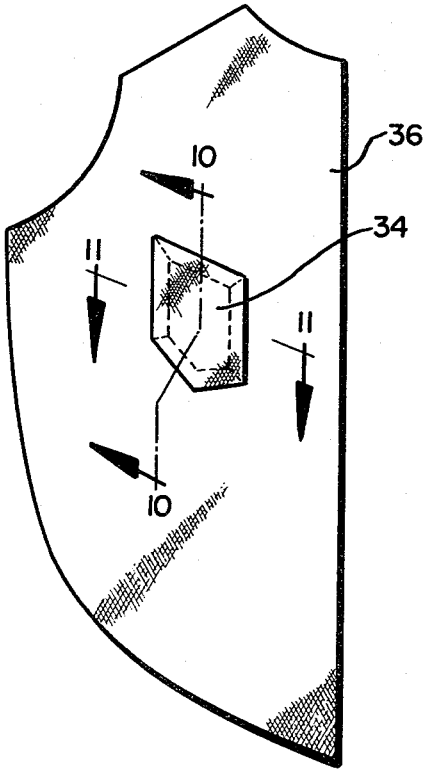
FIG. 9 is a small scale perspective view of a prepared pocket body applied to the upper surface of a garment portion.

After pocket blank 20 is cut from roll 26 of continuously supplied pocket blank material, pocket blank 20 is carried along conveyor 12 to second station 16. Detection means 32 are provided for detecting pocket blank 20 on conveyor 12 and for stopping the conveyor travel to dispose pocket blank 20 at second station 16 for application of adhesive as is shown particularly in FIG. 3, and subsequently to dispose the prepared pocket blank 34 at third station 18 for fusing to a garment portion 36, which is shown in FIGS. 1 and 9.

Second station 16 comprises a plurality 38 *a–e* of adhesive rolls for supplying adhesive strips 39 *a–e* to pocket blank 20, with each adhesive supply spool 38 *a–e* having a corresponding adhesive take-up spool 40 *a–e*. Corresponding spool tensioning means 43 may also be provided. A first heated platen 42 for creasing pocket blank 20 at appropriate places as set forth in greater detail hereinbelow in regard to the more detailed description of FIGS. 3–7 is provided. First heated platen 42 also serves to fuse the adhesive to pocket blank 20, thereby to form prepared pocket blank 34 as shown in FIGS. 1 and 2. First heated platen 42 may include an independently downwardly disposable center portion 45 for holding down pocket blank 20 during upward return of platen 42 after creasing and/or fusing.

Prepared pocket blank 34 is conveyed to third station 18, which includes preferably continuous means 44 for supplying garment portions 36 preferably to overlay each prepared pocket blank 34. Continuous garment portion supply means 44 is disposed preferably transversely to the direction of travel of conveyor 12, and includes a supply roller 46 for the garment material 47 and a garment portion material take-up roller 48, as shown in the direction of Arrow C. The result is a garment portion 36 having a pocket 34 fused to the underside thereof, as shown in phantom lines in FIG. 1, and as shown in inverted disposition in FIG. 9.

Referring now particularly to FIGS. 3–7, which show the elements of second station 16 in greater detail, laterally disposed air nozzles 50 *a–e* are provided above the surface 13 of conveyor 12 to direct streams of air (see Arrows D–G) against the corresponding top margin tab 52, side margin tabs 54 *a, b,* and bottom margin tabs 56 *a, b* of pocket blank 20. The position of pocket blank 20 with respect to second station 16 is controlled by detection means 32, which is known to those having ordinary skill in the art.

Figure 3:
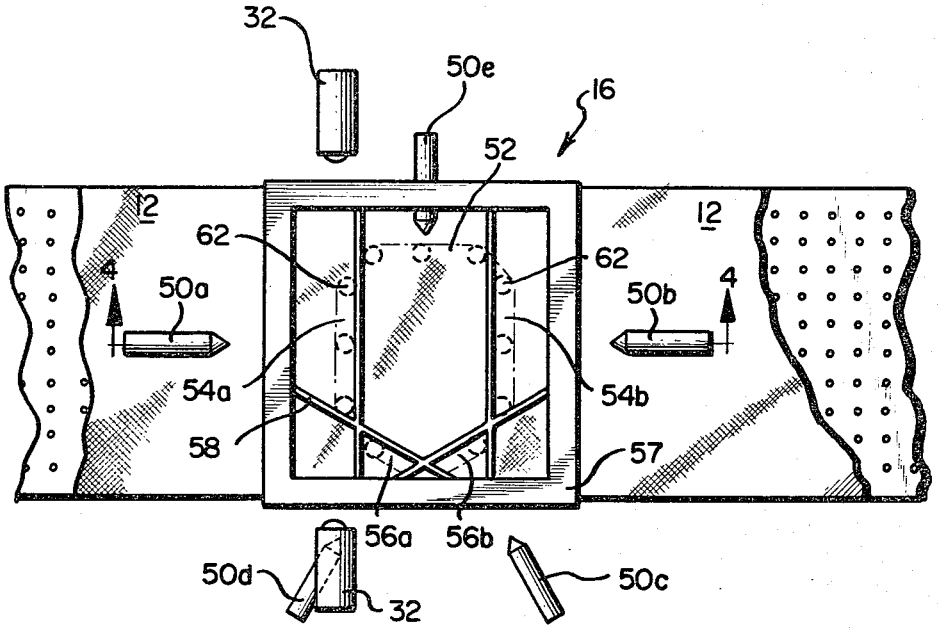
FIG. 3 is a more detailed and slightly enlarged view of station two with the above disposed heat and pressure means removed to illustrate preferred means in the form of a wire frame for demarcating the pocket body from the connected top, side and bottom member tabs of the pocket blank, said tabs to be folded over by means of side and bottom (shown in phantom lines) disposed air nozzles and also showing pocket blank edge detecting means.
Figure 4:
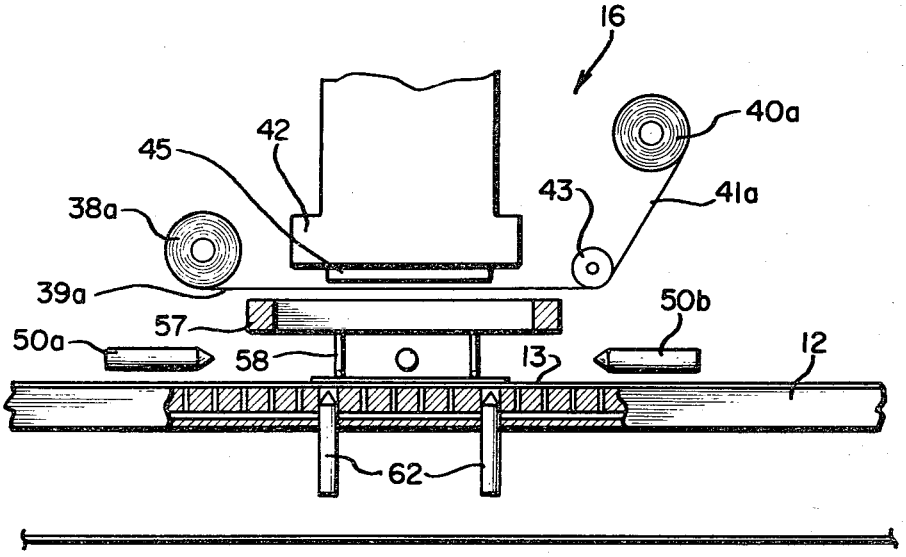
FIG. 4 is a side view taken along line 4—4 of FIG. 3 and further includes adhesive supply means in the form of supply and take-up spools and heat and pressure means in the form of a downwardly reciprocating heated platen for application of strips of adhesive to the pocket member tabs.
Figure 12:
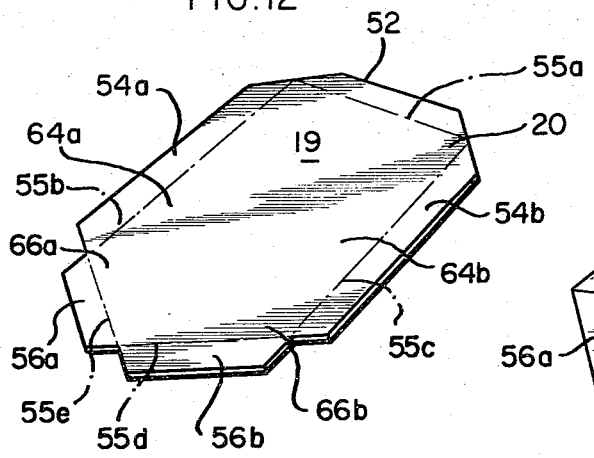
FIG. 12 is a perspective view of a pocket blank illustrating the pocket body, the top, side and bottom member tabs thereof, and the lines of demarcation therebetween.
Figure 13:
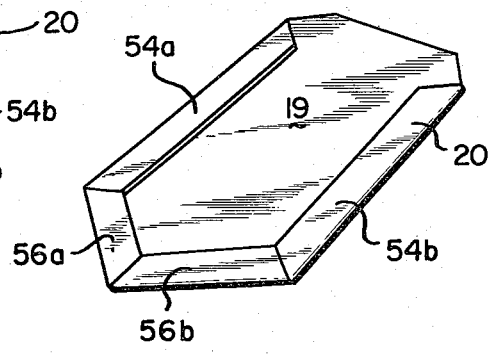
FIG. 13 is a perspective view of a pocket blank illustrating the bottom and side member tabs being folded over into general proximity with the rear surface of the pocket body to display the front surfaces of the tabs for application of adhesive thereto.

Preferably, a wire frame support 57 holding a wire frame 58 is disposed over pocket blank 20 at the lines of demarcation between the side margin tabs 54 *a, b* and bottom margin tabs 56 *a, b* thereof and the pocket body 60 as shown in FIGS. 3 and 4. When pocket blank 20 is correctly disposed by means of the detection means 32, laterally disposed air nozzles 50 *a–e* blast side and bottom margin tabs 54 *a, b* and 56 *a, b* respectively over wire frame 58 with the assistance of upwardly disposed air nozzles 62 which are disposed beneath the surface 13 of conveyor 12. These upwardly disposed air nozzles 62 are shown in phantom lines in FIG. 3. The result is to fold the respective member tabs 54 *a, b* and 56 *a, b* over and into general proximity with the respective adjacent areas 64 *a, b* and 66 *a, b* of pocket body 20 rear surface 68, as shown in FIG. 12, to display the front side of the tabs upwardly, as shown in FIG. 13. The sequencing of the various steps is set forth in greater detail with respect to FIGS. 5–7 hereof. Second station 16 also includes a heated platen 42 for creasing the various member tabs into intimate proximity with the adjacent areas of the pocket body rear surface and for tacking the respective adhesive strips 39 *a–e* thereto to prepare a pocket blank 34 for fusing to a garment portion 36 at third station 18. As shown in FIG. 4, each respective adhesive strip 39 *a–e* is borne on a corresponding carrier strip 41 *a–e*. The used carrier strips 41 *a–e* are respectively then taken up on corresponding take-up rollers 40 *a–e*.

Figure 5:
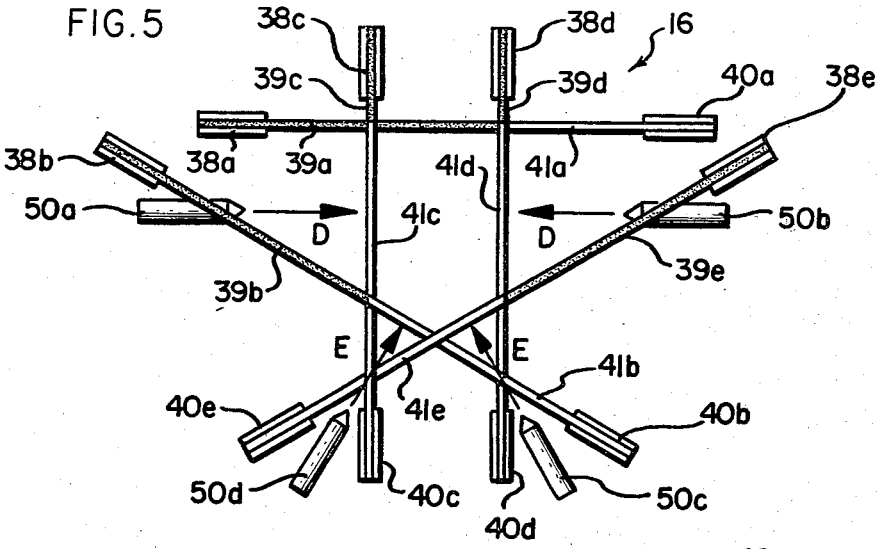
FIG. 5 is a schematic plan view of the respective spools for supplying the adhesive strip material to be fused to the respective member tabs and for taking up the adhesive release backing carrier strip, and illustrating the force of the member tab folding means in the form of air nozzles for folding the side member tabs over the wire frame (see Arrows D, D) and for folding the bottom member tabs over the wire frame (see Arrows E, E), and further schematically illustrating the incrementing and application of the adhesive strip to the top member tab.
Figure 6:
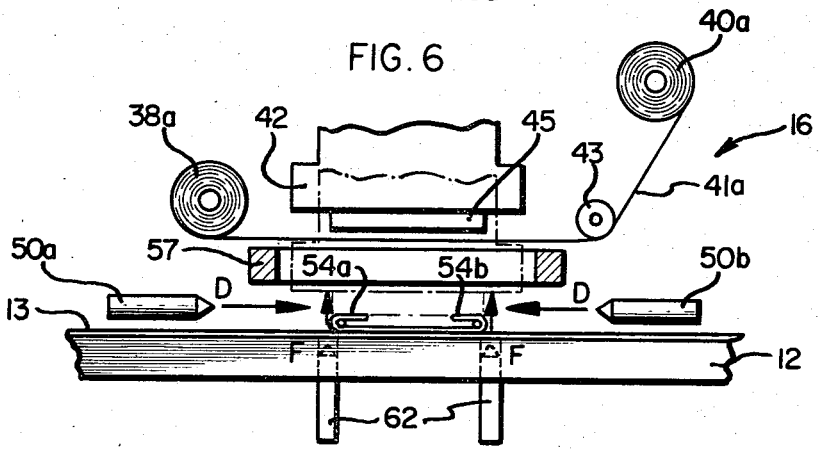
FIG. 6 is a longitudinal side view of station two illustrating the upward force of air nozzles (see Arrows F, F) to assist in folding the member tabs over the wire frame, and further illustrating in phantom lines the downward application of heat and pressure by means of the heated platen to the member tabs of the pocket blank folded over the wire frame thereby to crease the same.
Figure 7:
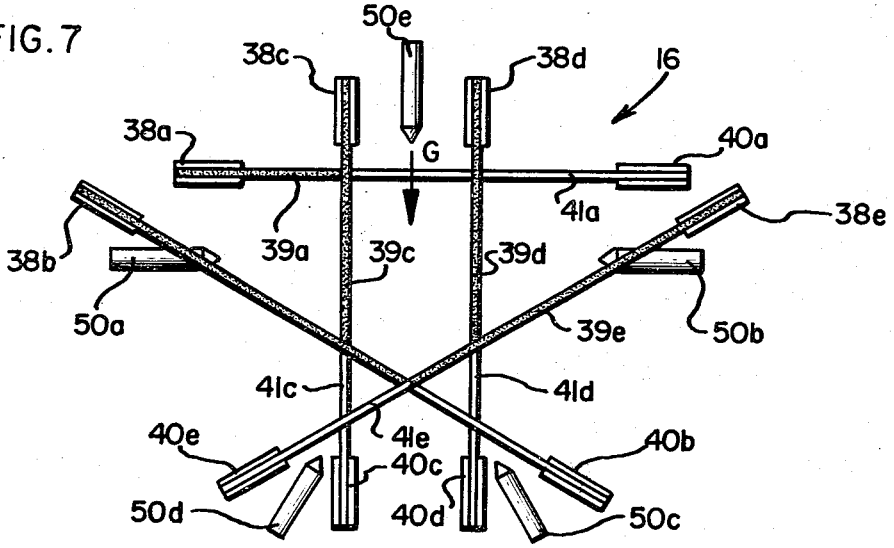
FIG. 7 is a schematic plan view illustrating application of adhesive strips which are properly incremented prior to being applied to the side and bottom member tabs of the pocket blank, and further illustrating the force of a top disposed air nozzle for folding over the top member tab (see Arrow G) for fusing.

FIGS. 5–7 schematically set forth the preferred sequencing of the operation of apparatus 10 of the present invention, and FIGS. 12–16 depict the results of the various preferred steps of the method of the present invention. With respect to FIG. 5, the lateral air nozzles 50 *a–e* blow jets of air as shown in Arrows D, D and E, E over the respective side and bottom member tabs 54 *a, b* and 56 *a, b* to fold the same over the wire frame 58. The top margin tab adhesive supply spool 38*a* dispenses a strip 39*a* of adhesive above the rear, and upward, surface of top margin tab 52. At this stage, the adhesive supply spool 38 *b–e* for the respective side and bottom margin tabs 54 *a, b* and 56 *a, b* are not activated.

With respect to FIG. 6, the laterally disposed air nozzles 50 *a–b* and upwardly disposed air nozzle 62 are shown blowing side margin tabs 54 *a, b* over folding wire frame 58, after which heated platen 42 is reciprocated downwardly to crease side and bottom margin tabs 54 *a, b* and 56 *a, b* and to tack and fuse top margin adhesive strip 39*a* to top margin tab 52.

Thereafter, and as shown in FIG. 7, top margin tab 52 to which adhesive strip 39*a* has been applied is blown over folded wire frame 58 by activation of top margin tab lateral air nozzle 50*c* (Arrow G). Simultaneously therewith, adhesive strip supply spools 38 *b–e* for the side and bottom margin tabs 54 *a, b* and 56 *a, b* are activated to dispose strips of adhesive 39 *b–e* above each of respective side and bottom margin tabs 54 *a, b* and 56 *a, b* as shown.

Figure 8:
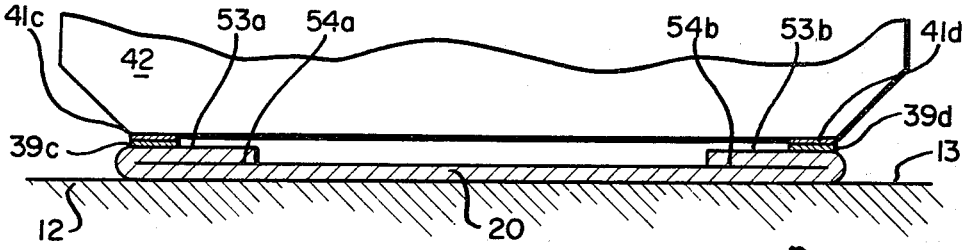
FIG. 8 is a greatly enlarged longitudinal side view showing the top member tab being creased and fused, and showing the application of the heated platen to the adhesive which is carried by the carrier strip, and which carrier strip is released therefrom when the adhesive is fused to the pocket member tab material.

FIG. 8 shows heated platen 42 pressing the adhesive strip downwardly and into contact with upwardly disposed respective front surfaces 53 *a, b* of the folded over side margin tabs 54 *a, b* which causes the respective adhesive strips 39*c*, 39*d* to become released from their respective carrier strips 41*c*, 41*d* and to remain fused to the respective front and upper surfaces 53 *a, b* of the respective side margin tabs 54 *a, b,* thereby to form a completed prepared pocket blank 34.

Prepared pocket 34 is then transported along conveyor 12 to third station 18 where a second heated platen 70 as shown in FIG. 2, and which also may incorporate for simultaneous functioning a die of the appropriate shape for cutting the garment portion 36, is provided. The result of such fusing is shown from the underside thereof in FIG. 9.

Figure 10:
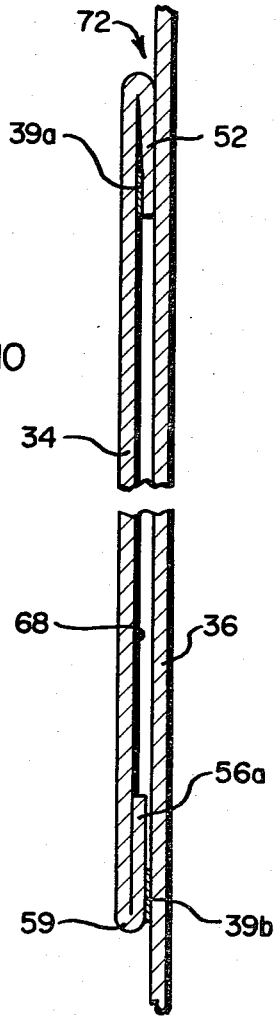
FIG. 10 is a greatly enlarged cross-sectional side view taken along line 10—10 of FIG. 9, and showing the fusing of the bottom member tab to the upper surface of the garment portion, and also showing the fusing of the top member tab to the pocket body to leave an access opening at the top of the fused on pocket to provide access for storing articles in the finished pocket of the garment.

FIG. 10 is a longitudinal cross-sectional view of fused pocket 34 taken along line 10—10 of FIG. 9. Bottom margin tab 56*a* is shown folded over and creased at crease line 59 and into intimate proximity with the rear surface 68 of prepared pocket blank 34 at the pocket body thereof. Bottom margin tab 56*a* is shown fused by means of corresponding adhesive strip 39*b* to garment portion 36. At the opposite end of pocket 34 is the opening generally 72 for placing objects in pocket 34. There, the adhesive strip 39*a* is shown bonding top margin tab 52 to the pocket body.

Figure 11:
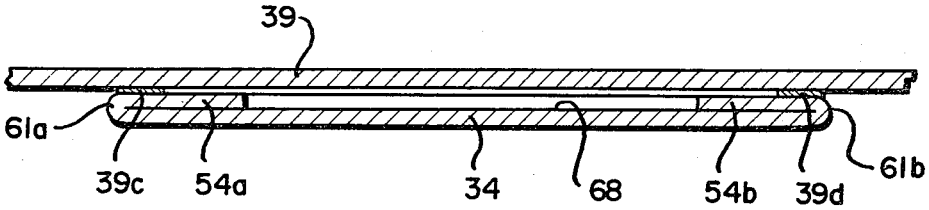
FIG. 11 is a greatly enlarged cross-sectional side view taken along line 11—11 of FIG. 9, and showing at opposite sides thereof the fusing of the side member tabs to the top portion of a garment body by means of the adhesive strip.

FIG. 11 is a transverse cross-sectional view of fused pocket 34 shown in FIG. 9 at line 11—11 thereof. Respective side margin tabs 54 *a, b* are shown to be reflexively folded and creased at their respective crease lines 61 *a, b* into intimate proximity with upper surface 68 of the pocket body. Respective adhesive strips 39*c*, 39*d* are disposed between the respective side margin tabs 54 *a, b* and the garment portion material 36, thereto to create the sides of pocket 34.

Figure 14:
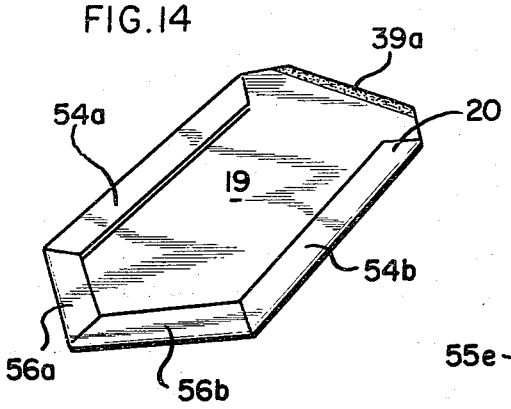
FIG. 14 is a perspective view of a pocket blank showing the bottom and side member tabs being creased into intimate proximity with the rear surface of the pocket body and further illustrating application of strip adhesive to the front surface of the top member tab.
Figure 15:
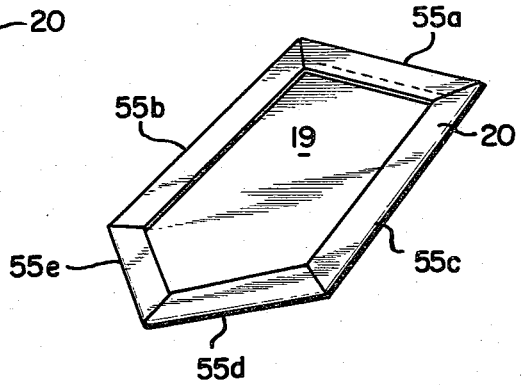
FIG. 15 is a perspective view of a pocket blank illustrating the folding over of the top margin tab bearing adhesive thereon into general proximity with the rear surface of the adjacent portion of the rear of the pocket body.
Figure 16:
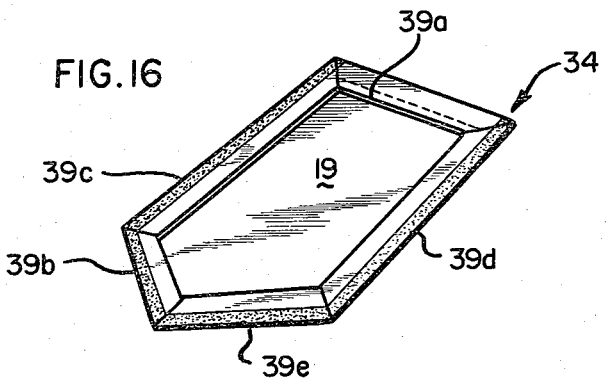
FIG. 16 is a perspective view of a pocket blank showing creasing of the top margin tab into intimate proximity with the adjacent rear surface of the pocket body to fuse the same thereto, and further showing application of strip adhesive to the upwardly disposed respective front surfaces of the side and bottom member tabs.

Referring now to FIGS. 12–16, the successive steps of the operations performed on pocket blank 20 to form prepared pocket blank 34 are set forth. FIG. 12 shows unprocessed pocket blank 20 having a pocket body 19 with a top margin tab 52, two side margin tabs 54 *a, b,* and two bottom margin tabs 56 *a, b,* which are each connected to the pocket body along respective fold lines 55 *a–e*. FIG. 13 shows side margin tabs 54 *a, b* and bottom margin tabs 56 *a, b* folded over in preparation for creasing. FIG. 14 shows the respective side margin tabs 54 *a, b* and bottom margin tabs 56 *a, b* creased and adhesive strip 39*a* applied to the upper surface of the top margin tab 52. FIG. 15 shows the top margin tab 52 folded over and the respective fold/crease lines 55 *a–e*. FIG. 16 shows the top margin tab 52 creased and fused with adhesive strip 39*a* shown in phantom lines, and adhesive strips 39 *b–e* applied to the respective side margin tabs and bottom margin tabs 54 *a, b* and 56 *a, b* in preparation for final fusing of prepared pocket blank 34 to the overlaid garment portion 36 at third station 18.

Although several forms of adhesive may prove to be useful in connection with the method and apparatus of the present invention, adhesives produced in accordance with U.S. Pat. No. 4,078,113 are recommended for use herein.

The basic and novel characteristics of the method and apparatus for bonding a pocket blank to a garment portion of the present invention will be readily understood from the foregoing disclosure by those skilled in the art. It will become readily apparent that various changes and modifications may be made in the form, construction and arrangement of the method and apparatus for bonding a pocket blank to a garment portion of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. A method of bonding a pocket blank to a garment portion, said method sequentially comprising the steps of:

providing a pocket blank having front and rear surfaces and comprising a pocket body and laterally extending top, bottom and side margin tabs;

conveying the pocket blank along a path of travel having a longitudinal dimension;

folding over the bottom and side margin tabs of the pocket blank into general proximity with the rear surface of the pocket body;

applying heat and pressure to a strip of heat fusing adhesive to fuse the same to the rear surface of the top margin tab of the pocket blank;

applying heat and pressure to the folded over side and bottom margin tabs of the pocket blank to crease the rear surface thereof into intimate contact with the adjacent portion of the rear surface of the pocket body;

folding over the top margin tab bearing adhesive thereon and applying heat and pressure thereto to bond the rear surface thereof to the rear surface of the adjacent portion of the rear of the pocket body;

applying heat and pressure to fuse strips of heat fusing adhesive to the respective front surfaces of the side and bottom margin tabs of the pocket blank;

providing a piece of garment cloth larger in size than that selected for the garment portion;

overlaying the garment cloth atop the prepared pocket blank to position the prepared pocket blank in the selected disposition thereon;

cutting the garment cloth to the shape selected for the garment portion;

applying heat and pressure to the garment portion and opposite the upwardly disposed adhesive strips on the front surface of the creased side and bottom pocket margin tabs to fuse the prepared pocket blank to the garment portion at the sides and bottom portions thereof to form a pocket thereon; and conveying the garment portion with pocket fused thereon away for assembly of the garment.

2. The method of fusing a pocket to a garment portion as claimed in claim 1, wherein the pocket blank is provided with two bottom margins in v-shaped disposition.

3. The method of fusing a pocket to a garment portion as claimed in claim 1, wherein the bottom and side margin tabs of the pocket blank are folded over by blasting compressed air under and lateral of the bottom and side margin tabs.

4. The method of fusing a pocket to a garment portion as claimed in claim 3, wherein during the air blasting the pocket body is bordered adjacent the side and bottom margin tabs to demarcate the pocket body during air blasting whereby the side and bottom margin tabs may be thereafter accurately creased.

5. The method of fusing a pocket to a garment portion as claimed in claim 1, wherein the pocket blank is restrained downwardly immediately after application of the respective adhesive strips to the top margin tab and to the side and bottom margin tabs to prevent the same from being carried upwardly.

6. The method of fusing a pocket to a garment portion as claimed in claim 1, wherein the garment portion is cut from the garment cloth simultaneously with the fusing of the prepared pocket blank to the garment portion.

7. The method of fusing a pocket to a garment portion as claimed in claim 1, comprising the additional steps of providing a continuous roll of pocket blank material disposed transversely to the longitudinal dimension of the path of travel of the pocket blank, and cutting the pocket blank from the continuous supply.

8. The method of fusing a pocket to a garment portion as claimed in claim 1, further comprising the step of cutting the pocket blank with its side margin tabs disposed substantially parallel to the longitudinal dimension of the path of travel.

9. The method of fusing a pocket to a garment portion as claimed in claim 1, wherein the pocket blank is disposed to be conveyed whereby its side margin tabs are disposed transverse to the longitudinal dimension of the path of travel.

10. The method of fusing a pocket to a garment portion as claimed in claim 1, wherein the garment blank is cut from a continuous supply of garment cloth which is disposed transverse to the longitudinal dimension of the path of travel.

11. The method of fusing a pocket to a garment portion as claimed in claim 1, wherein the same source of heat and pressure is utilized for the margin tab creasing, adhesive fusing and bonding steps to form the prepared pocket blank.

12. The method of fusing a pocket to a garment portion as claimed in claim 11, further comprising the step of conveying the prepared pocket blank along the longitudinal dimension of the path of travel for bonding thereof with the garment portion.

13. The method of bonding a pocket blank to a garmet portion, said method comprising the steps of:

providing a pocket blank having front and rear surfaces and comprising a pocket body and laterally extending top, bottom and side margin tabs;

conveying the pocket blank along a path of travel having a longitudinal dimension;

folding over the bottom and side margin tabs of the pocket blank into general proximity with the rear surface of the pocket body;

applying heat and pressure to a strip of heat fusing adhesive to fuse the same to the rear surface of the top margin tab of the pocket blank, and simultaneously applying heat and pressure to the folded over side and bottom margin tabs of the pocket blank to crease the rear surface thereof into intimate contact with the adjacent portion of the rear surface of the pocket body;

folding over the top margin tab bearing adhesive thereon and applying heat and pressure thereto to bond the rear surface thereof to the rear surface of the adjacent portion of the rear of the pocket body;

applying heat and pressure to fuse strips of heat fusing adhesive to the respective front surfaces of the side and bottom margin tabs of the pocket blank;

providing a piece of garment cloth larger in size than that selected for the garment portion;

overlaying the garment cloth atop the prepared pocket blank to position the prepared pocket blank in the selected disposition thereon;

cutting the garment cloth to the shape selected for the garment portion;

applying heat and pressure to the garment portion and opposite the upwardly disposed adhesive strips on the front surface of the creased side and bottom pocket margin tabs to fuse the prepared pocket blank to the garment portion at the sides and bottom portions thereof to form a pocket thereon; and conveying the garment portion with pocket fused thereon away for assembly of the garment.

14. A method of bonding a pocket blank to a garment portion, said method comprising the steps of:

providing a pocket blank having front and rear surfaces and comprising a pocket body and laterally extending top, bottom and side margin tabs;

conveying the pocket blank along a path of travel having a longitudinal dimension;

folding over the bottom and side margin tabs of the pocket blank into general proximity with the rear surface of the pocket body;

applying heat and pressure to a strip of heat fusing adhesive to fuse the same to the rear surface of the top margin tab of the pocket blank;

applying heat and pressure to the folded over side and bottom margin tabs of the pocket blank to crease the rear surface thereof into intimate contact with the adjacent portion of the rear surface of the pocket body;

folding over the top margin tab bearing adhesive thereon;

applying heat and pressure thereto to bond the rear surface thereof to the rear surface of the adjacent portion of the rear of the pocket body, and simultaneously applying heat and pressure to fuse strips of heat fusing adhesive to the respective front surface of the side and bottom margin tabs of the pocket blank;

providing a piece of garment cloth larger in size than that selected for the garment portion;

overlaying the garment cloth atop the prepared pocket blank to position the prepared pocket blank in the selected disposition thereon;

cutting the garment cloth to the shape selected for the garment portion;

applying heat and pressure to the garment portion and opposite the upwardly disposed adhesive strips on the front surface of the creased side and bottom pocket margin tabs to fuse the prepared pocket blank to the garment portion at the sides and bottom portions thereof to form a pocket thereon; and conveying the garment portion with pocket fused thereon away for assembly of the garment.

* * * * *